US006457667B1

(12) United States Patent
Golightly et al.

(10) Patent No.: US 6,457,667 B1
(45) Date of Patent: Oct. 1, 2002

(54) METHOD AND APPARATUS FOR CONTROLLING THE TENSION OF WIRE BEING PULLED FROM A WIRE SPOOL ON A BEAD WIRE LETOFF STAND

(75) Inventors: Ralph Wayne Golightly, Gadsden, AL (US); Kenneth David Pruitt, Jr., East Gadsden, AL (US)

(73) Assignee: The Goodyear Tire and Rubber Company, Akron, OH (US)

( * ) Notice: Subject to any disclaimer, the term of this patent is extended or adjusted under 35 U.S.C. 154(b) by 0 days.

(21) Appl. No.: 09/555,436

(22) PCT Filed: Feb. 4, 1998

(86) PCT No.: PCT/US98/00075

§ 371 (c)(1),
(2), (4) Date: May 30, 2000

(87) PCT Pub. No.: WO99/40011

PCT Pub. Date: Aug. 12, 1999

(51) Int. Cl.[7] ..... B65H 59/04; B65H 54/553

(52) U.S. Cl. ..... 242/421.5; 242/129.8; 242/156.2; 242/421.6

(58) Field of Search ..... 242/421.5, 421.6, 242/421.7, 420.6, 129.8, 128, 156.2

(56) References Cited

U.S. PATENT DOCUMENTS

| | | | | |
|---|---|---|---|---|
| 2,703,218 A | | 3/1955 | Haskell et al. | |
| 2,764,367 A | | 9/1956 | Brey | |
| 2,877,620 A | | 3/1959 | Blaisdell | |
| 2,961,183 A | | 11/1960 | Herr | |
| 3,032,245 A | | 5/1962 | George et al. | |
| 3,057,578 A | | 10/1962 | James | |
| 3,071,300 A | | 1/1963 | Justus | |
| 3,216,296 A | | 11/1965 | Forrester | |
| 3,612,377 A | | 10/1971 | Pembroke | |
| 3,788,515 A | | 1/1974 | Middleman | |
| 3,899,143 A | * | 8/1975 | Slezak | 242/156.2 |
| 3,936,008 A | * | 2/1976 | Crum | 242/421.7 X |
| 3,963,191 A | * | 6/1976 | Goodley | 242/421.6 X |
| 4,000,865 A | * | 1/1977 | Gaskins | 242/421.6 |
| 4,241,884 A | * | 12/1980 | Lynch | 242/156.2 X |
| 4,629,137 A | * | 12/1986 | Schippers et al. | 242/156 X |
| 4,709,572 A | * | 12/1987 | Hammer et al. | 242/421.6 |
| 5,188,218 A | | 2/1993 | Kuzik | |
| 5,385,621 A | | 1/1995 | Golightly | |
| 5,524,834 A | * | 6/1996 | Bogucki-Land | 242/156.2 X |
| 6,010,089 A | * | 1/2000 | Winafeld et al. | 242/156.2 X |
| 6,098,910 A | * | 8/2000 | Slezak | 242/421.5 X |

FOREIGN PATENT DOCUMENTS

| | | |
|---|---|---|
| FR | 1361900 | 4/1964 |
| GB | 2020854 | 11/1979 |

* cited by examiner

*Primary Examiner*—Michael R. Mansen
*Assistant Examiner*—Minh-Chau Pham
(74) *Attorney, Agent, or Firm*—Howard M. Cohn

(57) ABSTRACT

The present invention relates to an improved bead wire letoff assembly and method of operation that controls the tension of wire being pulled from a wire spool mounted to the bead wire letoff assembly. The improved wire letoff assembly can accurately control the rotational speed of the wire spool and incorporates a cam plate and tension arm linkage to control the braking force applied to the wire spool.

6 Claims, 5 Drawing Sheets

METHOD AND APPARATUS FOR CONTROLLING THE TENSION OF WIRE BEING PULLED FROM A WIRE SPOOL ON A BEAD WIRE LETOFF STAND

TECHNICAL FIELD

The present invention relates to a method and apparatus for removing bead wire off from a wire spool with a bead making machine and more particularly to a method and apparatus for controlling the tension of the bead wire being fed off of the wire spool mounted in a bead wire letoff stand.

BACKGROUND OF THE INVENTION

The tire building industry has been improving the methods and apparatus for controlling the tension of a wire or wires being fed into a bead making machine used in the manufacture of tire beads. The current practice is to place a roll or spool of wire in a device, commonly called a bead wire letoff stand, that allows the wire to be pulled from the spool at a controlled tension over a wide range of spool speeds (line speeds). The letoff stand must also be capable of stopping a full spool of wire at the maximum line speed. The control of the wire tension and the stopping of the rotating spool are typically accomplished with a braking device. One important consideration is that the latter mentioned functions of the braking device must be accomplished without allowing the mass of the spool to overcome the braking force of the braking device. Failure to overcome the inertia of the rotating mass would result in the spool of wire continuing to unwind. If the wire continues to unwind from the spool while not being used in the bead making machine, the wire will typically jump off the wire guide pulleys and accumulate as a heap of wire next to the let off stand.

In one current bead wire letoff stand, a somewhat complex mechanical linkage, includes a tension arm and linkage arms. A friction brake, mechanically connected to the tension arm, can apply a braking force to the wire spool depending upon the location of the tension arm. The pivot points in the tension arm and the associated linkage arms are prone to wear. Once the mechanical parts begin to wear, the letoff stand cannot maintain control of the tension of the wire being unwound from the wire spool and the stopping or slowing of the rotating wire spool as quickly and accurately as before the parts were at least somewhat worn. The mechanical linkage is adjustable by an operator so that the wire tension of the letoff stand can be held relatively constant irrespective of the mechanical wear. However, when a series of letoff stands are used in conjunction with each other to feed a plurality of bead wires a single bead forming device, each of the letoff stands typically exerts a somewhat different tension on the wire being unwound, as compared with the tension of a different one of the letoff stands. This variation in feed tension effects the winding tension of the beads, causing the formed wire beads to vary in inside diameter by several thousandths of an inch. This can result in an adverse effect on the quality and uniformity of the tire beads. In a worst case scenario, the tension varies enough to cause a problem known as "splitout," or uncontrolled separation of the bead ribbon in the bead making apparatus, causing expensive downtime of the assembly procedure while the wires are restrung. Another important limiting design consideration of the current letoff stand designs is that they are generally limited to a wire line speed of about 250 fpm (feet per minute) [76.2 mpm (meters per minute)] to about 300 fpm [91.44 mpm]. New manufacturing methods require a faster line speed of at least about 500 fpm [152.4 mpm].

Accordingly, there is a need in the tire building industry for a letoff stand design that can effectively control the line tension and provide for braking of the wire spool.

OBJECTS AND SUMMARY OF THE INVENTION

It is an object of the present invention to provide a method and apparatus for controlling the tension of wire being pulled from a wire spool mounted on a bead wire letoff assembly and being as defined in one or more of the appended claims and, as such, having the capability of being constructed to accomplish one or more of the following subsidiary objects.

It is an object of the present invention to provide a method and apparatus for controlling the tension of wire being pulled from a wire spool mounted on a bead wire letoff assembly.

It is still a further object of the present invention to provide an improved bead wire letoff assembly that can accurately control full reels of wire at a line speed above about 300 fpm [91.44 mpm].

It is a yet further object of the present invention to provide an improved bead wire letoff assembly that incorporates a cam operated in accordance with the location of a tension arm to control air pressure to an air brake that applies a braking force to a spool.

Accordingly, there is disclosed a bead wire let-off assembly into which is mounted include a rotating wire spool having bead wire unwound therefrom. A brake system for applying a braking pressure to the spool is provided with a pressure regulator controlling the braking pressure applied by the brake system. A tension responsive control arm engages the bead wire and moves in response to changes in bead wire tension. The control arm is operationally connected to the pressure regulator so that the braking pressure applied by the brake system to the wire spool is a function of the position of the control arm.

According to the invention, the brake system has a first axle secured to and extending outward from the rotating wire spool, the first axle having a first centerline therethrough about which the spool rotates. A first gear wheel is attached to the first axle and a second axle being disposed in parallel relation to the first axle has a second gear wheel secured in engaging relationship with the first gear wheel. A pressure activated brake mechanism is provided to applying a braking force to the second axle in response to the receipt of pressurized air from the pressure regulator.

Further according to the invention, a third axle is disposed in parallel relationship to the first and second axles. The third axle has the tension responsive control arm and a cam plate secured thereto whereby movement of the control arm causes rotational movement of the cam plate. The pressure regulator has a piston rod engaging a cam surface of the cam plate whereby rotational movement of the cam plate causes an actuator piston rod to regulate the air pressure delivered from the pressure regulator to the air pressure brake. A bias force application device applies a biased force to urge the tension responsive control arm towards a position where the brake force is fully applied.

Also according to the invention, the method of controlling the unwinding of bead wire from a rotating spool includes the steps of: applying a braking pressure to the rotating spool with a brake system; regulating the braking pressure applied by the brake system with a pressure regulator; and controlling the braking pressure applied by the brake system as a function of the position of a tension responsive control arm engaging the bead wire and pivotably moving in response to a change in tension of the bead wire.

The method further includes the steps of: applying the braking pressure with a pressure activated brake mechanism that receives pressurized air from the pressure regulator to control the braking pressure applied by the brake system; pivoting the tension responsive control arm and a cam plate secured to cause rotational movement of the cam plate; engaging a cam surface of the cam plate with a piston rod extending from the pressure regulator whereby rotational movement of the cam plate causes an actuator piston rod to regulate the air pressure delivered from the pressure regulator to the pressure brake; and applying a force to urge the tension responsive control arm towards a position where the brake force is fully applied.

BRIEF DESCRIPTION OF THE DRAWINGS

The structure, operation, and advantages of the presently preferred embodiment of the invention will become further apparent upon consideration of the following description taken in conjunction with the accompanying drawings, wherein.

DETAILED DESCRIPTION OF THE INVENTION

Figure 1:
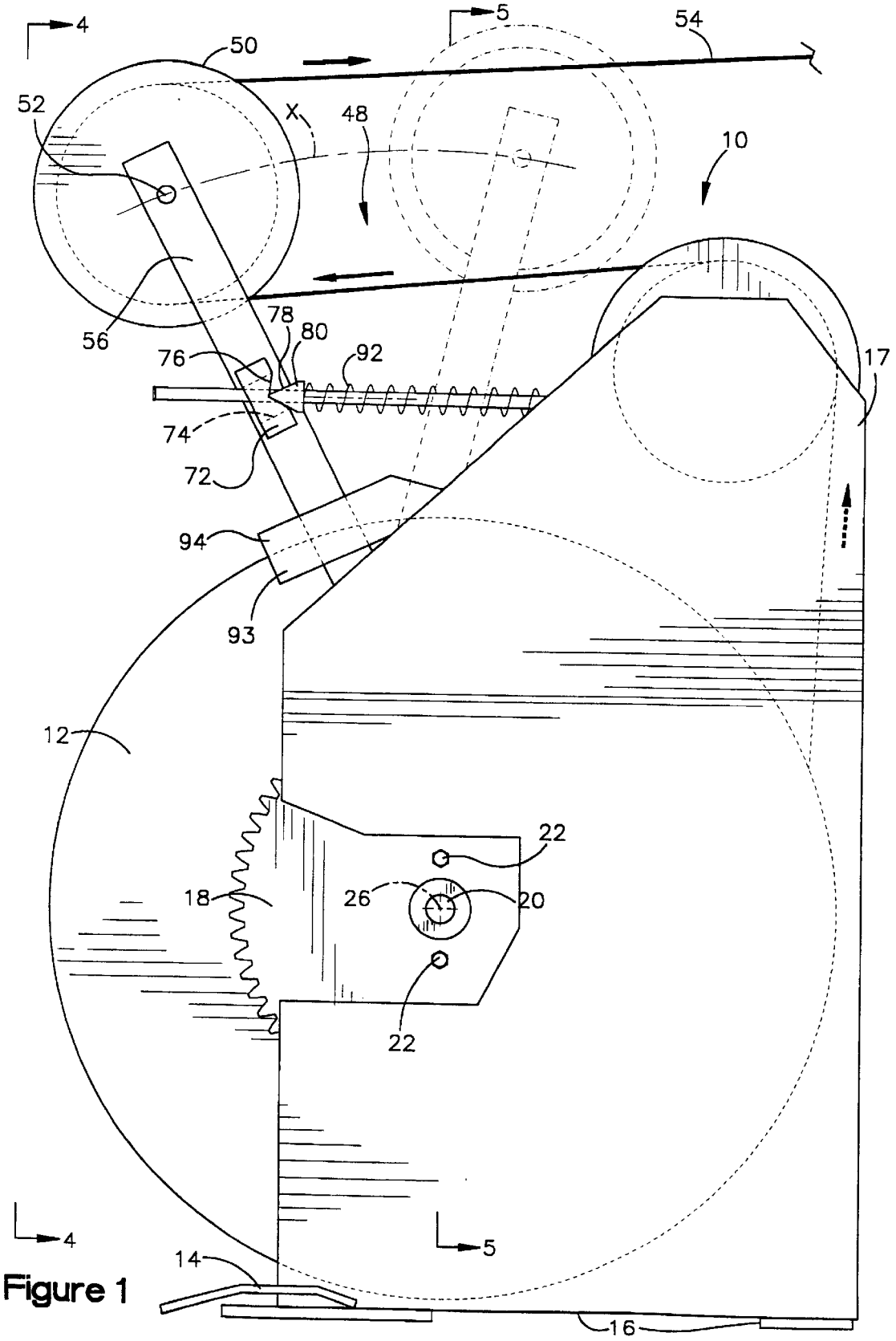
FIG. 1 is a side view of the bead wire letoff assembly of the present invention.

To best illustrate the present invention, FIG. 1 shows a bead wire letoff stand 10 onto which a reel or spool (used interchangeably) of wire 12 can be rotatedly mounted. Because of the heavy weight of the spool, typically in the range of about 900 pounds (lbs.) [6523.2 kg] to about 1000 lbs.[7248 kg], the wire spool 12 can be mounted in the stand 10 by means such as rolling the spool 12 across a mounting plate 14 fixedly secured to a base plate 16 of the stand 10. The side panels 17 of the stand 10 (only one illustrated in FIG. 1) cover portions of the letoff mechanism and are provided to protect the operator. Prior to mounting the spool 12 on letoff stand 10, a large circular gear 18, an 80 teeth gear being typical thereof, is mounted onto a spool axle 20. The resulting axle and gear assembly 21 is slid into place through a center bore extending through the spool 12 so that the outer ends 20*a*, 20*b* of the spool axle 20 project outward from either side of the spool sides 12*a* and 12*b*, respectively. The gear 18 is bolted to threaded bore extension elements 27, which are solidly attached to and project outward from spool side 12*a*, with threaded pins 22. The gear 18 has a central collar section 18*a* through which the axle 20 extends and can be removably attached thereto. The gear 18 is disposed in spaced relationship to the side wall 12*a* of spool 12 and maintained in that position by any conventional manner, such as with spacers 25, disposed about removable pins 22 and between the sidewall and the gear. While the gear and axle can move in conjunction with each other, it is also within the terms of the present invention for the gear 18 and the axle 20 to be arranged so that the gear can rotate independently about the axle's center of rotation through the centerline 26 of spool 12. The outer end sections 20*a* and 20*b* of axle 20 are secured to a front and a rear support plate 29*a* and 29*b*, respectively, of the letoff stand 10.

Figure 4:
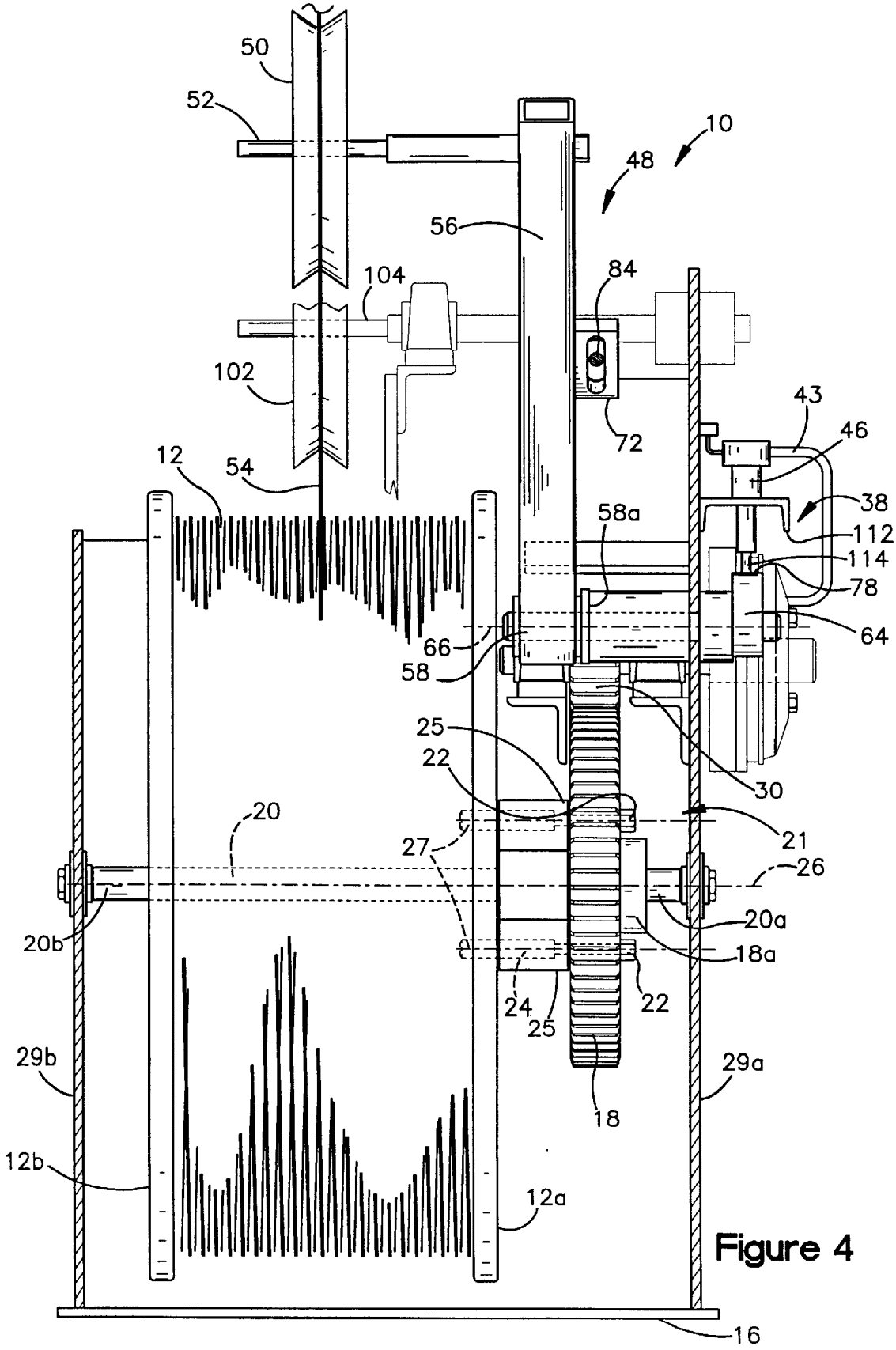
FIG. 4 is a left side view of the bead letoff stand through line 4—4 of FIG. 1.
Figure 5:
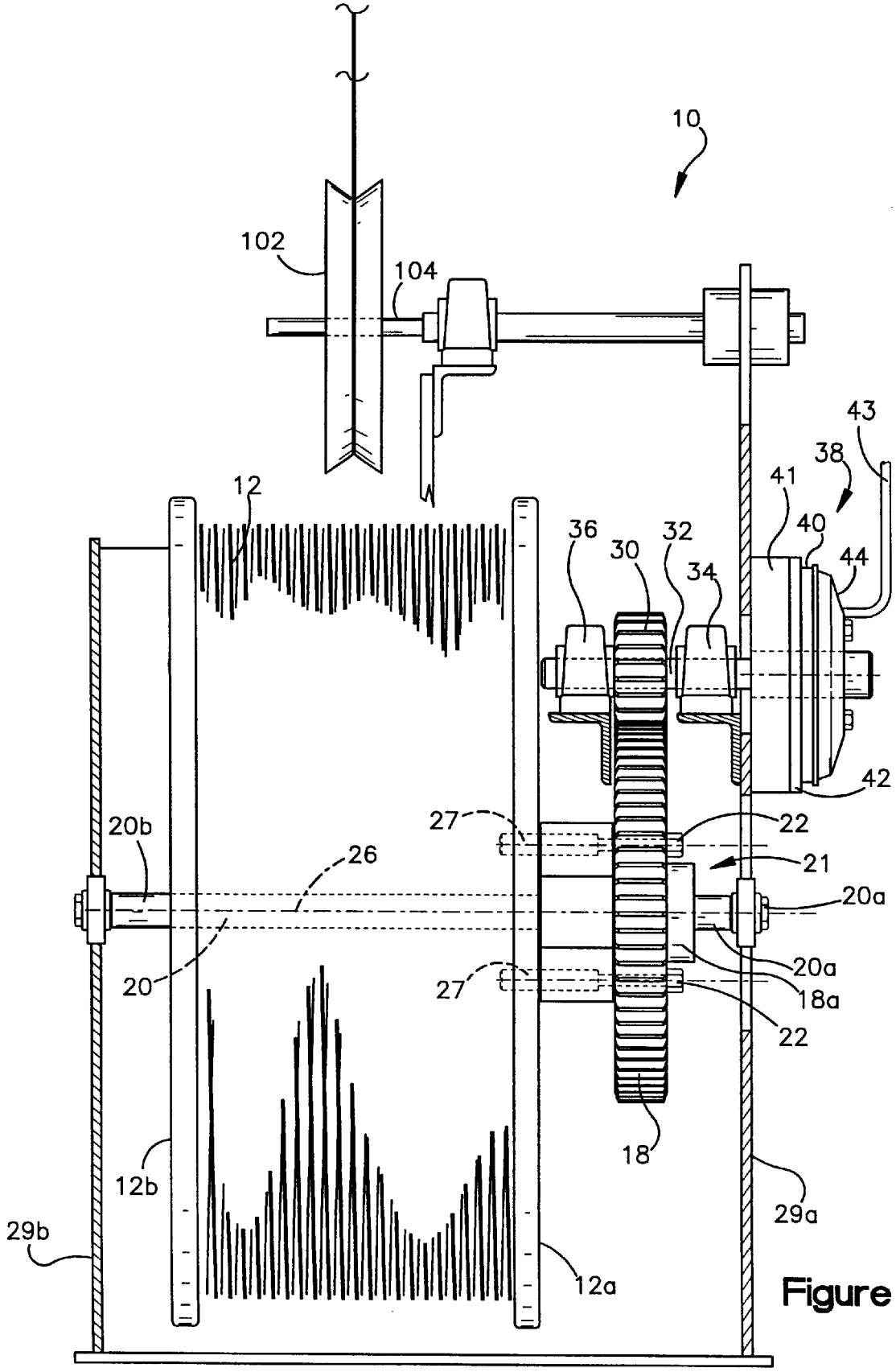
FIG. 5 is a left side view through line 5—5 of FIG. 1.

As best seen in FIG. 5, a circular gear 30 is mounted on an axle 32 which in turn is rotatably supported between two pillow block bearings 34 and 36. At one end of the shaft 32, a brake 38 is mounted. The brake 38, includes a circular friction pad 40, a circular metal braking plate 42 secured to the axle 32, and a fluid or air actuated piston member (not shown) connected to a pressure line 43 in the fluid or air actuator 44. In operation of the preferred embodiment, the air actuator 44, in response to control pressure air received through air pressure line 43 from control pressure regulator 46, as shown in FIG. 4, presses the friction pad 40 against the metal brake plate 42. The metal brake plate 42 is turned by the rotation of axle 32 whenever the spool 12 is rotating and is slowed or stopped by the pressure of the brake pad 40. The brake 38 can be secured to the wall 29*a* by the brake support base 41. This brake, by the mechanism just described, applies a braking force to the axle 32 which slows down or controls its speed of rotation. As axle 32 turns more slowly, the speed of rotation of circular gear 30 causes a correspondingly slow speed of rotation of gear 18 which is in meshing relation with gear 30. Accordingly, the speed of rotation of axle 20, which is secured to the wire spool 12, is reduced in relation to the pressure being outputted by control regulator 46, as shown in FIG. 4. As discussed in more detail below, control regulator 46 outputs a control air pressure into line 43 that is proportional to the position of arm 56.

BRAKE CONTROL SYSTEM

Figure 2:
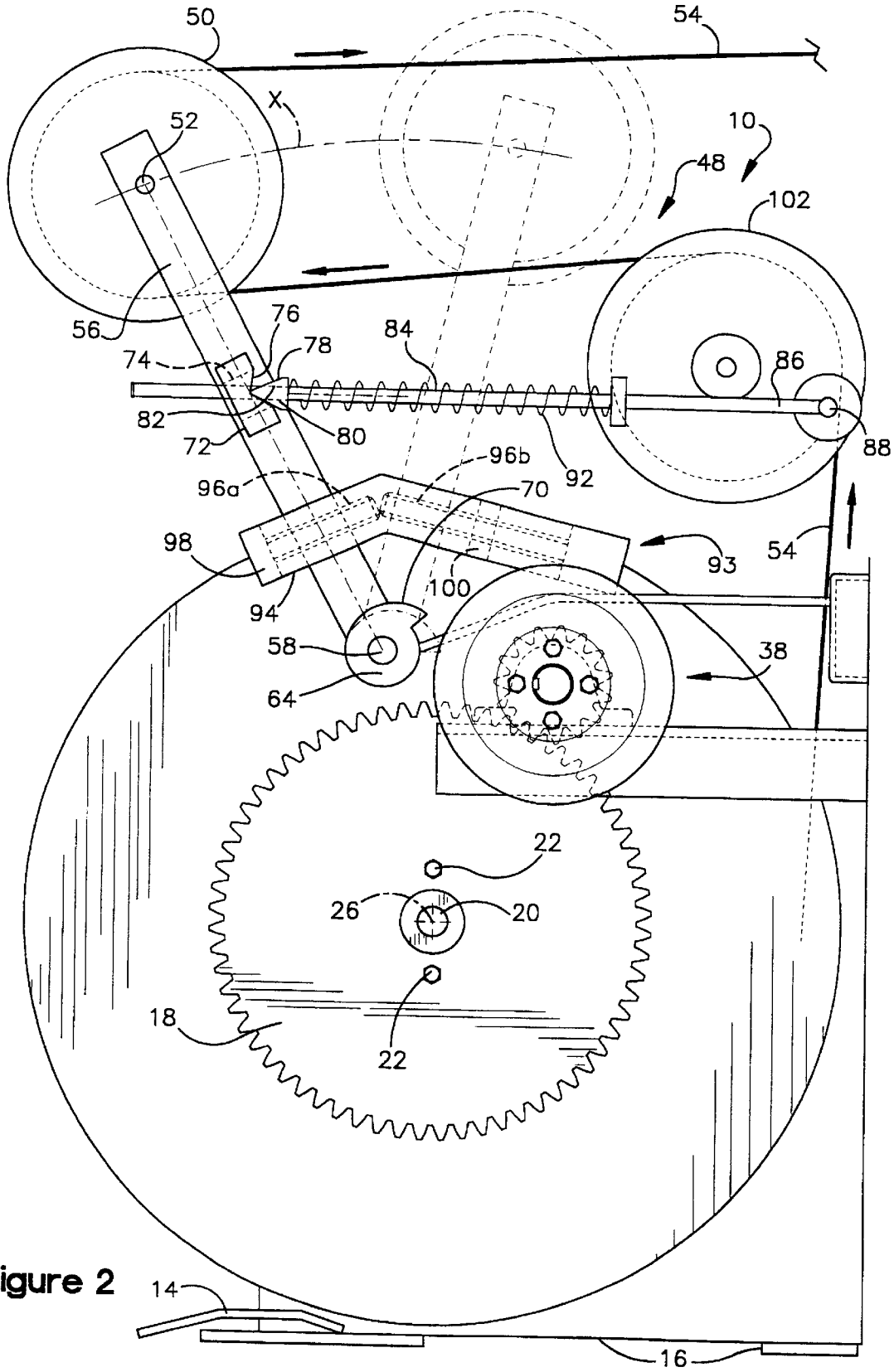
FIG. 2 is a side view of the bead wire letoff assembly of FIG. 1 with the side panel removed.
Figure 3:
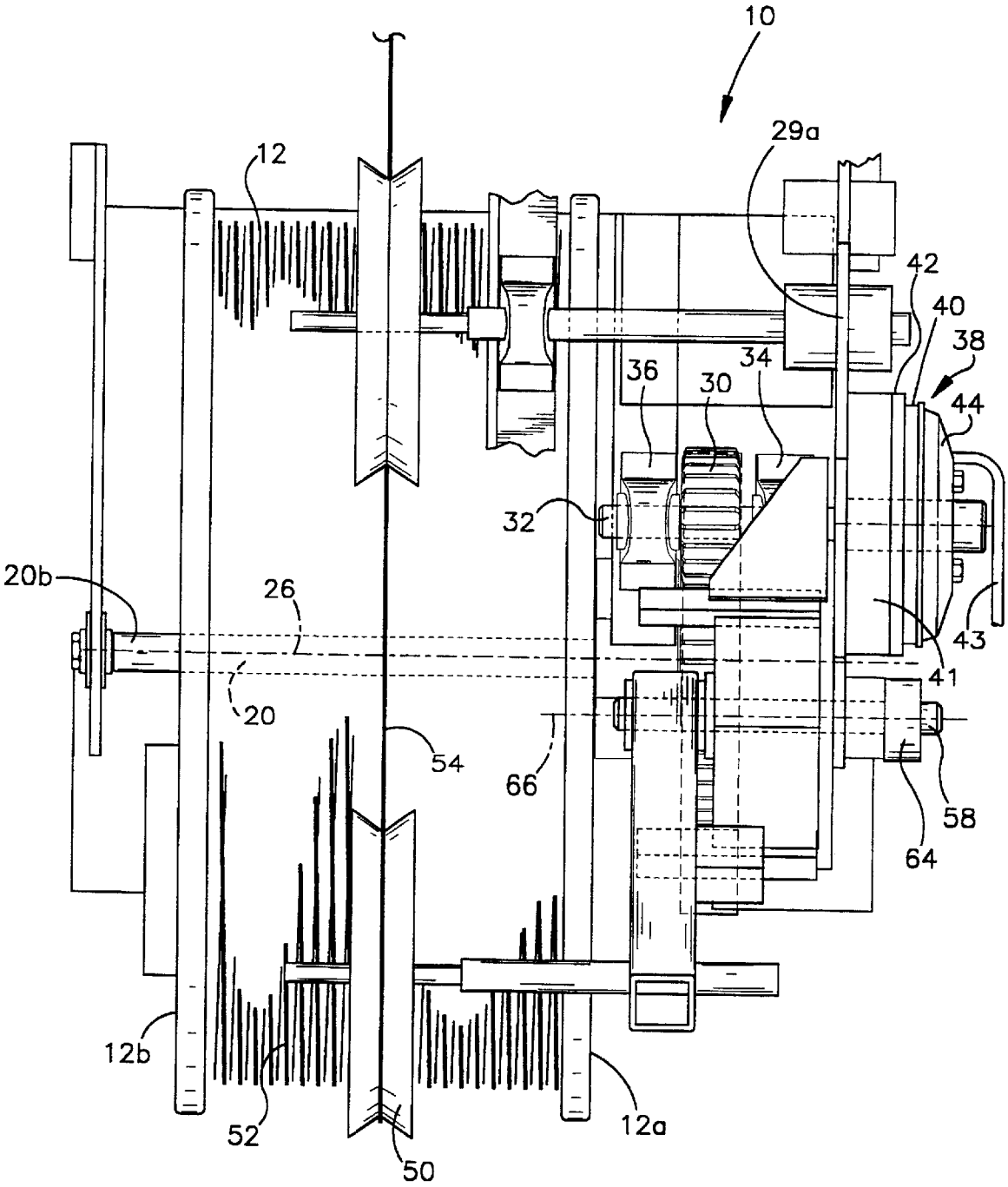
FIG. 3 is a top view of the bead letoff assembly shown in FIG. 1.

An aspect of the present invention relates to the control system 48 for transmitting a force corresponding to the tension of the wire being unwound from spool 10 to one end of a control arm 56 which in turn regulates the control regulator 46. The control system 48 includes a rotatable pulley 50 that is rotatably secured on an axle 52. The control arm 56 is fixedly mounted at an opposite end to an axle 58 which is rotatably mounted through bushing 58*a*. At the opposite end of axle 58, there is secured a cam plate 64, as best seen in FIGS. 2 and 4. As the control arm 56 pivots about the center line 66 through axle 58, as shown in FIG. 4, the cam plate 64 will also rotate about the axle so that the position of the cam surface 70 moves as discussed in more detail herein below.

Intermediate the ends of control arm 56, that is between the axle 52 and the axle 58, there is disposed a bias plate 72 having a central slot 74 extending therethrough, as shown in FIGS. 2 and 4. Along one side of the bias plate 72, there is formed a triangular shaped groove 76. The specific shape of the triangular groove 76 is not in and of itself an important feature of the present invention. However, the groove 76 does cooperate with a front triangular surface 78 of a block 80 having a cylindrical bore 82 and slidingly mounted on a tension rod 84. The tension rod 84 is pivotedly secured at one end 86 to an axle 88 secured by a bushing, not shown. A coiled spring 92 is disposed about the tension rod 84 and can extend from one end of the rod, near or at the axle 88, to a location in abutment with the block 80. The spring 92 produces a bias force that causes the triangular face 78 of the moveable block 80 to bear against the triangular groove 76 of the bias plate 72. As shown in FIG. 2, the tension rod 84 extends through the slot 74 of to the bias plate 72 so that the control arm 56 is free to move through an arc "x" of between about 40° and about 60°, and preferably at 45° to about 500 between two extreme positions. A bias force produced by the spring backed block 80 urges the control arm 56 towards a position closer to the location where wire 54 is being taken off or unwound from the wire spool 10. Note that the rod 84 can pivot about the axle 88 to accommodate the range of movement by the control arm 56.

In order to control the range or angle "x" of movement of control arm 56 between the end positions, a limit control structure is provided. The control structure 93 can be formed of a plate 94 and rodlike structures 96*a*, 96*b* spaced from plate 94 and providing a passageway through which the control arm 56 can freely pivot between the selected end positions. The end positions can be set for each particular application by providing moveable end plates 98 and 100 which are adjustably attached by conventional means to the rod structures 96*a*, 96*b*, respectively. The range of movement can be set by simply moving the end plates 98 and 100 closer or further from each other to achieve the movement arc of about 40° to about 60° and preferably about 45° to about 50°.

Referring to FIGS. 2 and 4, there is illustrated a letoff pulley 102 which is rotatedly mounted to a shaft 104 which in turn is secured to the wall 29*a*, as shown in FIGS. 4 and 5. The letoff pulley 102, while rotating, preferably remains at a fixed location on the axle 104.

Referring again to FIG. 4, the pressure control regulator 46 is mounted onto a plate 112 which in turn is secured to the side 29*a* of the letoff stand 10. A reciprocating pin 114 projects out of the lower end of the pressure regulator 46 and is biased into contact with the cam surface 70 of cam 64 by a bias mechanism within the pressure regulator (not shown). Movement of the pin 114 causes a change in the air pressure in line 43. The output air pressure from the air pressure control regulator 46 is transferred through the fluid actuator section 44 of brake 38. In the preferred embodiment, the brake 38 is activated by air. However, it is within the scope of the present invention to use other fluids or gases to activate the brake 38. In operation, the rotation of cam plate 64 in response to the pivoting of control arm 56 causes the rod 114 to reciprocate within the pressure regulator to control the air pressure being delivered from the pressure regulator to the brake 38 through line 43.

OPERATION OF SYSTEM

After assembly 21 has been attached to a wire spool 12 a gear and axle, the wire spool is rolled into the bead wire letoff stand 10 and mounted by the ends 28*a*, 28*b* of the spool axle so that it is free to rotate about the center line 26 with gear 18 engaged with gear 30, as best shown in FIG. 5. Next, the bead wire 54 is threaded around the pulley 102, in a counter-clockwise direction as shown in FIG. 2, and then around the pulley 50.

Prior to the wire 54 being pulled from the pulley 50, the control arm 56 will be abutted against the end plate 98 of the limit control structure 93. Spring 92, about the tension rod 84, biases the block 80 against the bias plate 72 to maintain a bias force against the control arm 56 in the direction of the end position set by the end plate 98. With the control arm in this position, the pin 114 of pressure regulator 46 bears against the cam surface 70 of cam 64 at a location which is furtherest from the center line 66 through axle 58. This causes the introduction of the high pressure air to the brake 38 so that a brake force is applied to axle 32 which quickly slows down and finally stops rotation of the axle as next described. Gear plate 30, which is mounted onto axle 32 is likewise prevented from rotating. Since gear 30 is in meshing relation with gear 18, gear 18 slows down and then stops axle 20 and spool 12 from rotating. Then, as wire 54 is drawn from the pulley 50, pulley 50 moves in a clockwise direction, as shown in FIGS. 1 and 2, which in turn causes the control arm 56 to pivot about axle 58 in a clockwise direction toward the limit plate 100. This movement of control arm 56 is restrained by the bias of spring 92 pressing the block 80 against the bias plate 72. Concurrent with the pivotable movement of control arm 56, cam plate 64 rotates in the clockwise direction. The control regulator pin 114, which is in abutting engagement with the cam surface 70, moves closer to the axle 58 and causes the pressure regulator 46 to decrease the air pressure delivered through line 43 to brake 38. Pressure regulator 46 is adjusted so that the wire spool 12 rotates about axle 20 in a controlled manner corresponding to the tension force exerted by the wire on the pulley 50. As the control arm 56 pivots in the clockwise direction, the air pressure is reduced so that the speed of rotation of the wire spool 10 is increased.

As the speed of the wire 54 being pulled from the wire spool 12 is decreased, the control arm 56 moves quickly towards the position where the air pressure regulator 46 provides increased air pressure to the air brake 38 to immediately slow or stop the rotation of wire spool 10. In effect, the control arm 56 reaches a substantially equilibrium position between the limit plates 98 and 100 of the limit control structure 92 and cycles back and forth slightly depending on the letoff speed and related tension of the wire 54. This enables increased line speeds of between about 400 fpm [121.92 mpm] and about 475 fpm [144.58 mpm] and preferably up to about 600 fpm [182.88 mpm]. Nevertheless, if the line speed is suddenly slowed down or stopped, such as by a slowing down in the bead manufacturing device or a break in the wire, the braking force will be immediately applied to wire spool 12. The braking force will cause the rotation speed of the wire spool 12 to slow down or almost immediately stop to prevent the wire from continuing to spool off of the wire spool 12 and typically become tangled on the plant floor which is both wasteful and time consuming for an operator to rethread the wire onto the pulleys.

It is apparent that there has been provided in accordance with this invention an improved bead wire letoff assembly and method of operation that satisfy the objects, means and advantages set forth hereinbefore. According to the invention, there is provided a method and apparatus for controlling the tension of wire being pulled from a wire spool mounted on a bead wire letoff assembly. The improved wire letoff assembly can accurately control full reels of wire at a line speed above about 500 fpm [152.4 mpm] and incorporates a cam plate operated in accordance with the location of a tension arm to control air pressure to an air brake that applies a braking force to the wire spool.

While the invention has been described in combination with embodiments thereof, it is evident that many alternatives, modifications, and variations will be apparent to those skilled in the art in light of the foregoing teachings. Accordingly, the invention is intended to embrace all such alternatives, modifications and variations as fall within the spirit and scope of the appended claims.

We claim:

1. A bead wire let-off assembly, characterized by:

a brake system for applying a braking pressure to a rotating spool having bead wire unwound therefrom;

a pressure regulator controlling the braking pressure applied by the brake system;

a tension responsive control arm engaging the bead wire and pivotably movable in response to a change in tension of the bead wire to control the braking pressure applied by the brake system as a function of the position of the control arm; the brake system is further characterized by:

a first axle secured to and extending outward from the rotating spool, the first axle having a first centerline therethrough about which the spool rotates;

a first gear wheel attached to the first axle;

a second axle having a second centerline therethrough, the second centerline being disposed in parallel relation to the first centerline;

a second gear wheel secured to the second axle so that the first wheel gear is in engaging relationship with the second gear; and a pressure activated brake mechanism for applying a braking force to the second axle.

2. The bead wire let-off assembly of claim 1 characterized in that the pressure activated brake mechanism is an air pressure brake that receives pressurized air from the pressure regulator to control the braking pressure applied by the brake system.

3. The bead wire let-off assembly of claim 2 characterized in that a third axle is disposed in parallel relationship to the first and second axles, the third axle having the tension responsive control arm and a cam plate secured thereto whereby movement of the control arm causes rotational movement of the cam plate.

4. The bead wire let-off assembly of claim 3 characterized in that the pressure regulator has an actuator pin engaging a cam surface of the cam plate whereby rotational movement of the cam plate causes the actuator pin to regulate the air pressure delivered from the pressure regulator to the air pressure brake.

5. The bead wire let-off assembly of claim 4 further characterized by a bias force application device to apply a force to urge the tension responsive control arm towards a position where the brake force is fully applied.

6. The bead wire let-off assembly of claim 5 further characterized by a limit control structure to limit the pivotable movement of the tension responsive control arm between first and second positions.

* * * * *